United States Patent [19]

Wilkinson

[11] 4,348,842

[45] Sep. 14, 1982

[54] LOCKING POST

[76] Inventor: Henry L. Wilkinson, 210 W. Latimer, Tulsa, Okla. 74106

[21] Appl. No.: 167,648

[22] Filed: Jul. 11, 1980

[51] Int. Cl.[3] ..... E02D 5/74

[52] U.S. Cl. ..... 52/166; 52/156; 52/298

[58] Field of Search ..... 52/155, 165, 166, 298, 52/156

[56] References Cited

U.S. PATENT DOCUMENTS

| | | | |
|---|---|---|---|
| 289,349 | 11/1883 | Hyndman | 52/166 |
| 443,018 | 12/1890 | Underwood | 52/166 |
| 788,685 | 5/1905 | Trumbo | 52/166 |
| 1,025,823 | 5/1912 | Morrow | 52/166 |
| 3,694,978 | 10/1972 | Mintz | 52/298 |
| 4,133,154 | 1/1979 | Ruzicka | 52/298 |

*Primary Examiner*—Price C. Faw, Jr.
*Assistant Examiner*—Henry E. Raduazo
*Attorney, Agent, or Firm*—William S. Dorman

[57] ABSTRACT

A locking post comprising a vertical post with two spaced horizontal plates attached to the bottom portion of the post. Each plate is reinforced and supported by a steel rod passing through the post and running parallel and beneath the plate. The upper plate is positioned above the lower plate and is disposed in a direction which is generally at right angles to the disposition of the lower plate. The post is set in a hole in the ground with the plates being disposed beneath the surface of the ground. When the assembled parts are covered with dirt, the crossed plates will prevent removal of the post.

1 Claim, 4 Drawing Figures

LOCKING POST

BACKGROUND OF THE INVENTION

1. Field of the Invention

The present invention relates to a post and, more particularly, to a post which is locked in position under the surface of the ground by means of a pair of angularly related horizontal plates positioned on the post below the level of the ground.

2. The Prior Art

The prior art discloses many different proposals and devices for locking a post under the surface of the ground. Morrow, U.S. Pat. No. 1,025,823, shows a fence arrangement where the posts are of "L", "T" or "H" cross-sectional configuration. According to Morrow's design, each post is provided with at least a pair of anchor plates spaced apart by earth or any other filling. Morrow shows the details of two styles of anchor plates. In FIG. 1, the anchor plate "h" is elongated and is adapted to slide along a plurality of posts. Morrow shows, in FIG. 2, another style of plate which is cruciform in shape. In FIG. 9 of Morrow, another plate "j" is shown as resting at the bottom of the hole, but the shape of this plate "j" is not fully disclosed. FIG. 9 also discloses an upper plate "k" which appears to cover the entire cross section of the hole but whose shape is not otherwise disclosed. Morrow discloses in FIG. 10 a still further plate "$k^1$". Again, the shape of the plate "$k^1$" in FIG. 10 is not fully disclosed. In any event, Morrow describes the erecting of the post in a hole in terms of taking a post with an anchor plate at its base, setting the post in a hole with this plate positioned at the bottom, then fixing the plate by driving a spike or bolt through a suitable hole in the post above the plate. Earth or the like is then filled in and rammed down over the anchor plate, partially filling the hole. Thereafter, one or more of the higher anchor plates is slideably positioned on the post. The higher plate is then forced down on the filled-in earth and fixed against rising by the use of another bolt or pin which is passed through another hole in the post above the higher anchor plate.

Trumbow, U.S. Pat. No. 788,685, shows a fence post 1 which is A-shaped in form. At its lower end, the post 1 is bent out to provide oppositely disposed and laterally extending feet 3. A rectangular anchoring collar 4 formed of clay, stone or other suitable material is slipped over the apex of the post and forced down until it rests on the upper sides of the feet 3, when the feet 3 are resting at the bottom of a hole in the ground. A block 6, preferably formed of a material analogous to that from which the collar is constructed, is provided with angular side recesses 7. The block 6 is turned slightly and inserted between the sides of the A-shaped post and pushed downwardly so as to lie upon the upper surface of the collar 4 at right angles thereto, the recesses 7 being received in the inclined sides of the posts. Thereafter a suitable filling, preferably earth, is placed in the hole surrounding the feet, collar and block, and then tamped. In order to further brace the post, a second collar 8, as shown in FIG. 2 of Trumbow, is placed over the post and pushed down, the hole having been partially filled, so as to support the collar above the block. Finally, the hole is filled and packed above the second collar so as to fill the entire opening.

Other patents showing post anchors are Hyndman, U.S. Pat. No. 289,349; Underwood, U.S. Pat. No. 443,018; Minz, U.S. Pat. No. 3,694,978; and Ruzicka, U.S. Pat. No. 4,133,154.

SUMMARY OF THE INVENTION

The locking post of the present invention comprises an elongated cylindrical post which is preferably made of steel. Mounted on the post are a pair of spaced and parallel horizontal metal plates which are in the shape of the elongated rectangles. The lower plate is disposed above the bottom of the post and is held in position by a lower rod which passes beneath the plate through a lower hole in the post. The upper plate is positioned above the lower plate and is disposed in a direction which is generally at right angles to the disposition of the lower plate. The upper plate is also held in position by means of an upper rod which is adapted to pass beneath the plate through another hole in the post. The holes in the post are disposed generally at right angles (non-parallel) to each other. Each plate is provided with a central hole so that the plate may be received on the post.

In order to create the locking assembly, the upper plate, for example, is positioned on the post above the top drilled hole and the steel rod is inserted into this top drilled hole, thus holding the top plate in position. Thereafter, the lower plate is positioned on the post above the lower hole and the lower steel rod is then inserted into the lower hole to hold the lower plate in position.

After assembly has been made of the components as described above, the assembly is placed in a suitable hole in the ground with the two plate below the surface of the ground and the assembled parts are covered with dirt, thereby locking the post in position under the surface of the ground. This lock is achieved by virtue of the fact that the two plates and their supporting rods are positioned at right angles with respect to each other.

DETAILED DESCRIPTION OF THE PREFERRED EMBODIMENTS

Figure 1:
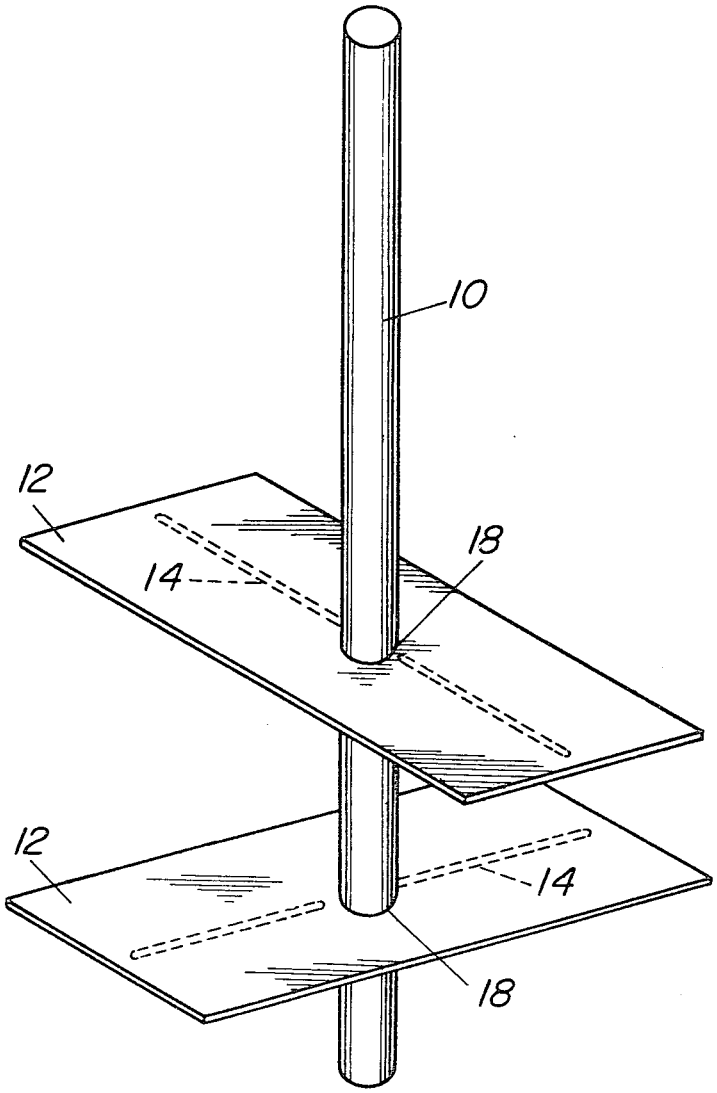
FIG. 1 is a perspective view of the locking post of the present invention with plates and rods attached, the rods being shown in dotted lines.
Figure 2:
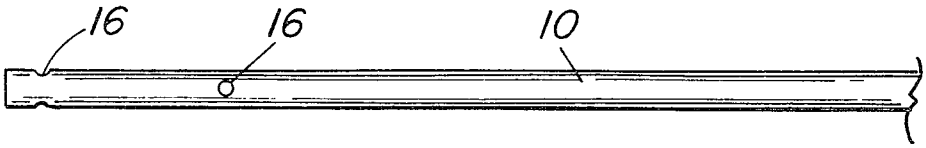
FIG. 2 is a side elevation of a portion of the post shown in FIG. 1.
Figure 3:
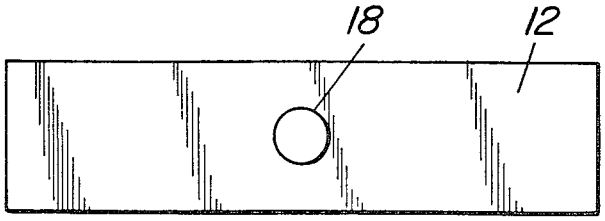
FIG. 3 is a plan view of one of the plates shown in FIG. 1.
Figure 4:
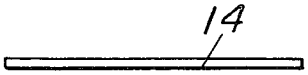
FIG. 4 is a side elevation of one of the rods shown in FIG. 1.

Referring to the drawings in detail, FIG. 1 shows an elongated cylindrical post 10 which is made of steel and which is preferably, but not necessarily, two inch IPS pipe of standard wall thickness. Mounted on the post 10 are a pair of spaced and parallel horizontal metal plates 12 which are in the shape of elongated rectangles as best shown in FIGS. 1 and 3. The lower plate 12 is disposed above the bottom of the post 10 and is held in position by a lower rod 14 which passes beneath the plate and through a lower hole 16 in the post 10. The upper plate 12 is positioned above the lower plate 12 and is disposed in a direction which is generally at right angles to the disposition of the lower plate. The upper plate 12 is also held in position by means of an upper rod 14 which is adapted to pass beneath the plate and through another hole 16 in the post 10. As best shown in FIG. 2, the holes 16 are disposed generally at right angles (non-parallel) to each other. That is, it should be obvious from a consideration of FIG. 2 that the two holes 16 are spaced apart from each other adjacent the bottom of the post 10 and are disposed in a non-parallel relationship; for the sake of simplicity, this non-parallel relationship of the holes 16 will also be referred to as a right angled relationship. Each plate 12 is preferably cut from galvanized tin of 20 gauge thickness and has an outer rectangular dimension preferably of about 24"×10". Each plate 12 is provided with a central hole 18 so that the plate may be received on the post 10 as shown in FIG. 1. In the event that the post 10 is constructed of 2" IPS pipe, of standard wall thickness, the hole 18 is preferably about 2½" in diameter. Each rod 14 is preferably of steel and of at least 9" in length. The rod 14 is preferably about 178 " in diameter and the hole 16 is preferably about 9/16" in diameter.

In order to create the assembly shown in FIG. 1, the upper plate 12, for example, is positioned on the post 10 above the top drilled hole 16 and the steel rod 14 is inserted into this top drilled hole, thus holding the top plate 12 in position. Thereafter, the lower plate 12 is positioned on the post 10 above the lower hole 16 and the lower steel rod 14 is then inserted into the lower hole 16 to hold the lower plate in position.

After assembly has been made of the components shown in FIG. 1, the assembly is placed in a suitable hole in the ground with the two plates below the surface of the ground, and the assembled parts are convered with dirt, thereby locking the post in position under the surface of the ground. This lock is achieved by virture of the fact that the two plates and their supporting rods are positioned at right angles with resepct to each other.

I claim:

1. A locking post comprising an elongated cylindrical vertical post having a pair of vertically spaced and horizontally extending holes located above but adjacent to the bottom of the post, said holes being oriented in directions at right angles to each other, a pair of spaced horizontal flat rectangular plates mounted on the posts above the holes and extending in a generally right angular relationship with respect to each other, and a horizontal rod passing through each hole immediately below each plate to maintain the plates in position on the posts, whereby the assembly can be placed in a suitable hole in the ground with the plates below the surface of the ground and whereby the suitable hole can be filled in with dirt to cover both plates.

* * * * *